US007240385B1

(12) United States Patent
Brown

(10) Patent No.: US 7,240,385 B1
(45) Date of Patent: Jul. 10, 2007

(54) DEVICE FOR RAISING AT LEAST A PORTION OF A MATTRESS

(76) Inventor: Arnold Benjamin Brown, 59 32 164th St., Flushing, NY (US) 11365

( * ) Notice: Subject to any disclaimer, the term of this patent is extended or adjusted under 35 U.S.C. 154(b) by 0 days.

(21) Appl. No.: 11/528,199

(22) Filed: Sep. 27, 2006

(51) Int. Cl.
*A47C 20/04* (2006.01)

(52) U.S. Cl. ..... 5/660; 5/617; 5/648

(58) Field of Classification Search ..... 5/659, 5/648, 634, 509.1, 632, 660, 616–618
See application file for complete search history.

(56) References Cited

U.S. PATENT DOCUMENTS

| | | | | |
|---|---|---|---|---|
| 3,931,653 | A | 1/1976 | Bien | |
| 4,005,497 | A | 2/1977 | Sutter | |
| 4,309,783 | A | 1/1982 | Cammack et al. | |
| 4,651,365 | A | 3/1987 | Zeigler | |
| 5,425,150 | A | 6/1995 | Palmer, Jr. et al. | |
| 5,481,769 | A | 1/1996 | Schneider | |
| 5,829,077 | A * | 11/1998 | Neige | 5/618 |
| 6,061,852 | A * | 5/2000 | Bathrick et al. | 5/618 |
| 6,681,425 | B2 | 1/2004 | Leventhal et al. | |
| 6,907,631 | B2 * | 6/2005 | Heaton | 5/618 |
| 6,951,037 | B2 | 10/2005 | Weinman et al. | |
| 6,961,971 | B2 | 11/2005 | Schneider et al. | |
| 2005/0076440 | A1 * | 4/2005 | Taguchi et al. | 5/618 |

FOREIGN PATENT DOCUMENTS

GB 2094138 A * 9/1982

* cited by examiner

*Primary Examiner*—Patricia Engle
*Assistant Examiner*—William Kelleher
(74) *Attorney, Agent, or Firm*—Collard & Roe, P.C.

(57) ABSTRACT

A device for positioning between a box spring and a mattress for selectively raising at least a portion of the mattress has a base frame secured to the box spring or box spring frame. A mattress supporting frame is pivotally coupled to the base frame. A leveraging arm with a roller bearing is pivotally coupled to the base frame. A linear actuator having a electric motor and a displaceable shaft is pivotally coupled to the leveraging arm and extension of the shaft pivots the leveraging arm upwardly, raising the roller bearing against a cross member of the mattress supporting frame to lift a portion of the mattress. Mattress restraining members prevent the mattress from shifting as the mattress is raised. The base frame is adapted to nest within the mattress supporting frame when the device is in a lowered position to minimize the vertical space required for the device.

10 Claims, 5 Drawing Sheets

DEVICE FOR RAISING AT LEAST A PORTION OF A MATTRESS

BACKGROUND OF THE INVENTION

1. Field of the Invention

The invention relates to devices for selectively raising at least a portion of a mattress. More particularly, the invention relates to a device for raising a portion of a mattress, wherein the device can be positioned between a box spring and the mattress and occupies only a small amount of vertical space.

2. The Prior Art

Various devices for selectively raising a portion of a mattress are known. The following references, the disclosures of which are hereby incorporated by reference, relate to devices for raising and/or lowering a portion of a mattress.

U.S. Pat. No. 5,829,077 to Neige relates to a device for tilting the top or bottom end of a bed using a worm screw mechanism. U.S. Pat. No. 5,481,769 to Schneider shows a lifting apparatus for piece of furniture incorporating a scissor jack mechanism. U.S. Pat. Nos. 5,425,150 to Palmer Jr., et al., 6,681,425 to Leventhal et al. and 4,309,783 to Cammack et al. all show devices for raising or lowering a mattress with an inflatable bellows or bladder element. U.S. Pat. No. 4,651,365 to Zeigler describes a portable bed raiser using vertical support posts and a linear and circular gear mechanism. U.S. Pat. No. 3,931,653 to Bien shows a power operated back rest for an adjustable bed which uses a motor-driven screw and nut mechanism. U.S. Pat. No. 4,005,497 to Sutter shows a device having a U-shaped gear rack for adjusting the inclination of reclining furniture.

U.S. Pat. No. 6,961,971 to Schneider et al. describes a motor adjustable support device for a mattress having a railed base body and a support element adjustable relative to the base body. U.S. Pat. No. 6,061,852 to Bathrick et al. shows a power integrated articulated inner spring mattress wherein all of the power drive components for articulation are contained within the inner spring mattress. U.S. Pat. No. 6,951,037 to Weinman et al. describes a universal adjustable bed wherein the linkage and drive mechanisms are disposed within a housing to give the appearance of a conventional box spring.

Although a number of devices for selectively raising a portion of a mattress are known, known devices are typically complex and costly and occupy a large amount of space. Moreover, existing designs fail to account for the inherent tendency of a mattress to remain flat upon application of the lifting force unless suitably restrained.

Accordingly, a need exists for a simple, inexpensive and compact device for raising a portion of a mattress. Furthermore, a need exists for such a device which includes one or more restraining members for preventing the mattress from shifting as the mattress is raised.

SUMMARY OF THE INVENTION

A device for positioning between a box spring and a mattress for selectively raising at least a portion of the mattress according to an embodiment of the invention includes a base frame secured to the box spring or to a frame supporting the box spring. The base frame has a first side disposed proximate a head section of the mattress and a second side disposed distal the head section. A mattress supporting frame having a first side disposed proximate the head section of the mattress, a second side disposed distal the head section of the mattress and a cross member extending therebetween, is pivotally coupled to the second side of the base frame.

A leveraging arm with a roller bearing is pivotally coupled to the second side of the base frame. A linear actuator including an electric motor and a displaceable shaft pivotally coupled to the leveraging arm is disposed on the base frame. Extension of the linear actuator's shaft pivots the leveraging arm upwardly, raising the roller bearing against the cross member to lift said mattress supporting frame. The base frame is adapted to nest within or into the mattress supporting frame when the device is in a lowered position to minimize the vertical space required for the device.

A first mattress restraining member is disposed at the first side of the mattress supporting frame for preventing the mattress from shifting as the mattress is raised. A second mattress restraining member is disposed at a foot section of the mattress for preventing the mattress from shifting as the mattress is raised.

The second mattress restraining member may include a base member for resting on the box spring with a first side and a second side opposite the first side. A mattress supporting member has a first side pivotally coupled to the first side of the base member and a second side opposite the first side of the mattress supporting member. A plate member is disposed at the second side of the mattress supporting member for preventing the mattress from shifting as the mattress is raised. An elevating member disposed at the second side of the base member extends upwardly from and substantially perpendicular to the base member. A movable support is pivotally coupled to an upper portion of the elevating member and is movable between a first position substantially parallel to the elevating member for maintaining a foot portion of the mattress in a substantially horizontal position and a second position substantially perpendicular to the elevating member for elevating the foot portion of the mattress.

A device according to an embodiment of the invention provides a portable, compact motorized adapter for converting a conventional mattress and box spring into an adjustable bed. The device is designed primarily for bedridden or recuperating in-home patients.

One advantage of a device according to an embodiment of the invention is that mattress restraining members are provided at either end of the mattress to prevent the mattress from shifting as a portion of the mattress is raised. The mattress restraining members thus prevent the mattress from drifting forward or back as the mattress tries to revert to its natural non-flexed state during the lifting process.

A device according to an embodiment of the invention easily adapts to the box spring of an existing bed and is designed to be positioned between the box spring and mattress. The device allows for in-home performance of daily lifting tasks required for aging and/or infirm persons and reduces back strain on both care giver and patient.

A device according to an embodiment of the invention is designed to occupy very little vertical space and employs a compact, nesting frame above a frame design. The device uses a unique, space-saving off or above fulcrum push configuration and is powered by proven linear actuators.

An embodiment of the invention also provides a non-powered leg elevation feature for users who may benefit from having the foot portion of the mattress elevated.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
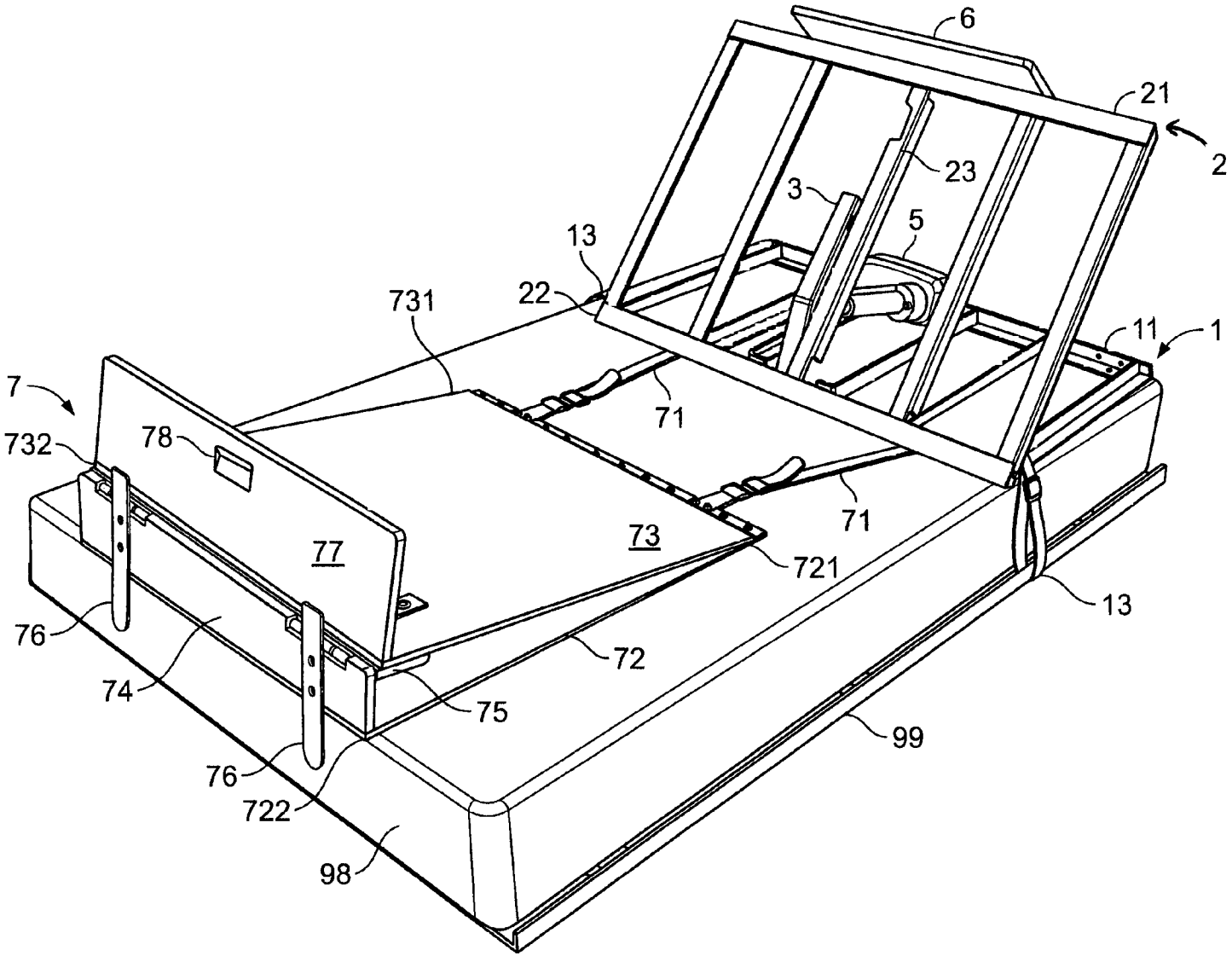
FIG. 1 shows a perspective view of a device for positioning between a box spring and a mattress for selectively raising a portion of the mattress according to an embodiment of the invention.

Referring now in detail to the drawings and, in particular, FIG. 1 shows a perspective view of a device for positioning between a box spring 98 and a mattress (not shown) for selectively raising a portion of the mattress. The mattress and box spring may be, for example, a twin or full size mattress and box spring. Preferably, the mattress comprises a foam hospital-type mattress.

As shown, the device includes a base frame 1 which is secured to the box spring 98 or to a frame 99 supporting the box spring 98. Base frame 1 is sized so as to rest on an upper surface of box spring 98. Preferably, base frame 1 is secured to box spring 98 or frame 99 with one or more anchoring straps 13. Anchoring straps 13 may be looped around frame 99 as shown in FIG. 1 and secured with buckles, snaps, hook and loop type fasteners or any other suitable fastener. Alternatively, the anchoring strap or straps may be positioned under the box spring 98 and/or frame 99 and extend across the width of box spring 98 from one side of base frame 1 to an opposite side of base frame 1. Anchoring straps 13 may be secured to base frame 1 at a location adjacent to a point where a movable mattress supporting frame 2 pivots with respect to base frame 1. For example, anchoring straps 13 may be secured to protruding attachment bolts disposed on each side of base frame 1 adjacent to the pivot point of the device.

Figure 3:
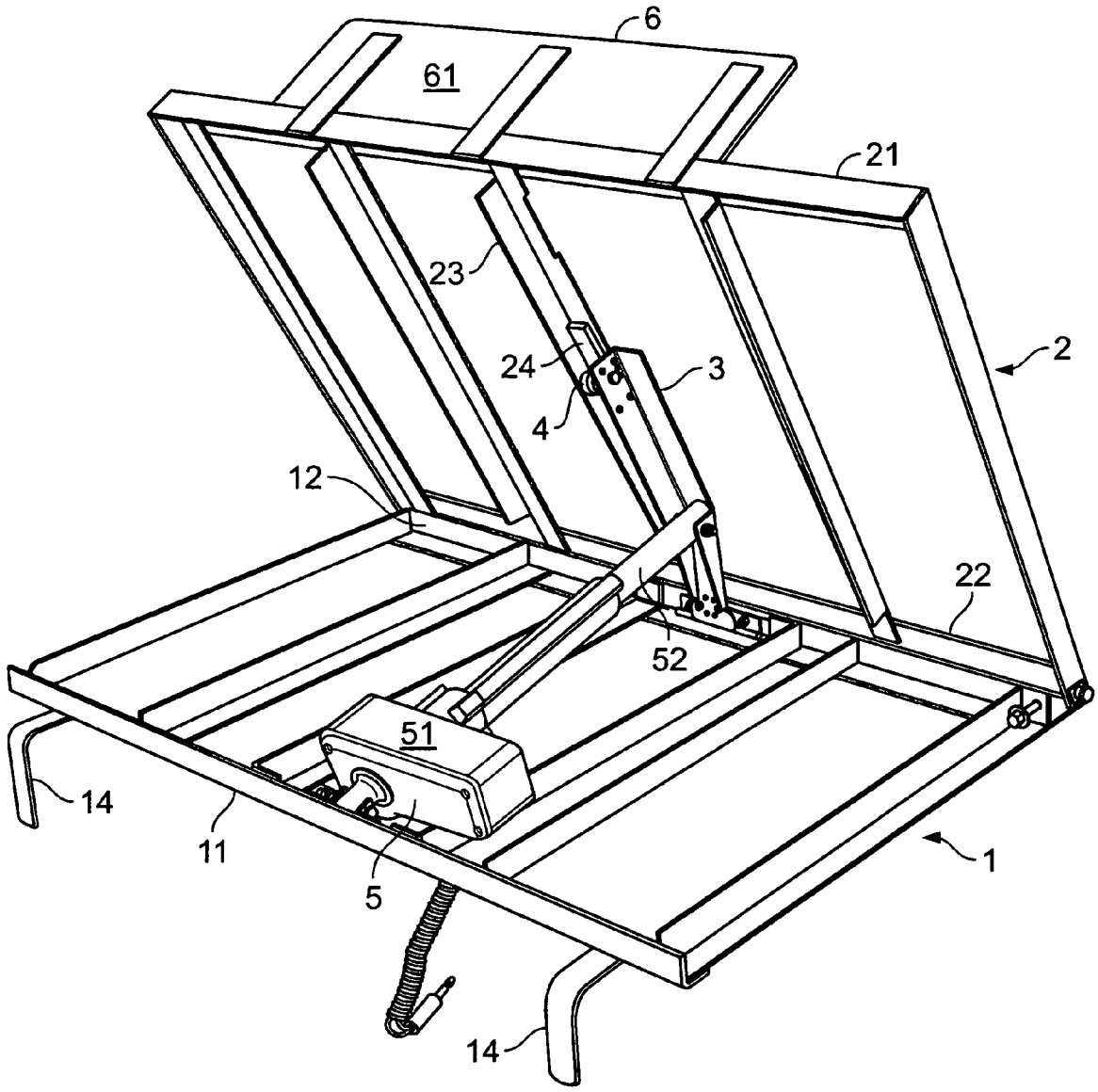
FIG. 3 shows a perspective view of a device according to an embodiment of the invention in a raised position.

As best shown in FIG. 3, base frame 1 has a first side 11 disposed proximate a head section of the mattress and a second side 12 disposed distal the head section. As shown, base frame 1 may be constructed to have a substantially rectangular frame. Base frame 1 may comprise a plurality of rigid members which may be welded, bolted or otherwise joined together to form the base frame assembly. Alternatively, base frame 1 may be formed as a single unit. Base frame 1 may be constructed from any suitable rigid material of appropriate strength. For example, base frame 1 may be constructed from a plurality of metal rails bent at substantially right angles along their length, also known as angle iron.

As best shown in FIG. 3, one or more brackets 14 may extend downwardly from first side 11 of base frame 1 for limiting a movement of the device as the mattress is raised. Brackets 14 may engage box spring 98 as the mattress is lifted to prevent the base frame 1 and mattress supporting frame 2 assembly from moving toward the foot end of the bed.

Mattress supporting frame 2 includes a first side 21 disposed proximate the head section of the mattress, a second side 22 disposed distal the head section of the mattress and a cross member 23 extending therebetween. Mattress supporting frame 2 may be constructed to have a substantially rectangular frame and may comprise a plurality of rigid members which may be welded, bolted or otherwise joined together to form the mattress supporting frame assembly. Alternatively, mattress supporting base frame 2 may be formed as a single unit. Mattress supporting frame 2 may be constructed from any suitable rigid material of appropriate strength. For example, mattress supporting frame 2 may be constructed from a plurality of metal rails bent at substantially right angles along their length, also known as angle iron.

Mattress supporting frame 2 is designed to support the headboard end of the mattress. The perimeter of mattress supporting frame may comprise four sides or rails. The length of the two parallel longer rails forming first side 21 and second side 22 is sufficient to support the width of a given mattress. The two parallel side rails may be considerably shorter. Additional rails may be included to provide additional strength. The overall perimeter of the mattress supporting frame 2 is designed to support the upper torso portion of the patient.

Second side 22 of mattress supporting frame 2 is pivotally coupled to second side 12 of base frame 1 as shown. Base frame 1 and mattress supporting frame are freely coupled at one end with a hinge and form a V shape when mattress supporting frame 2 is in an inclined position, as shown in FIG. 3. The hinged connection between base frame 1 and mattress supporting frame 2 may be formed in any suitable manner, for example with appropriately-sized through holes, shoulder bolts, washers and lock nuts, for example nylon insert lock nuts.

Figure 2:
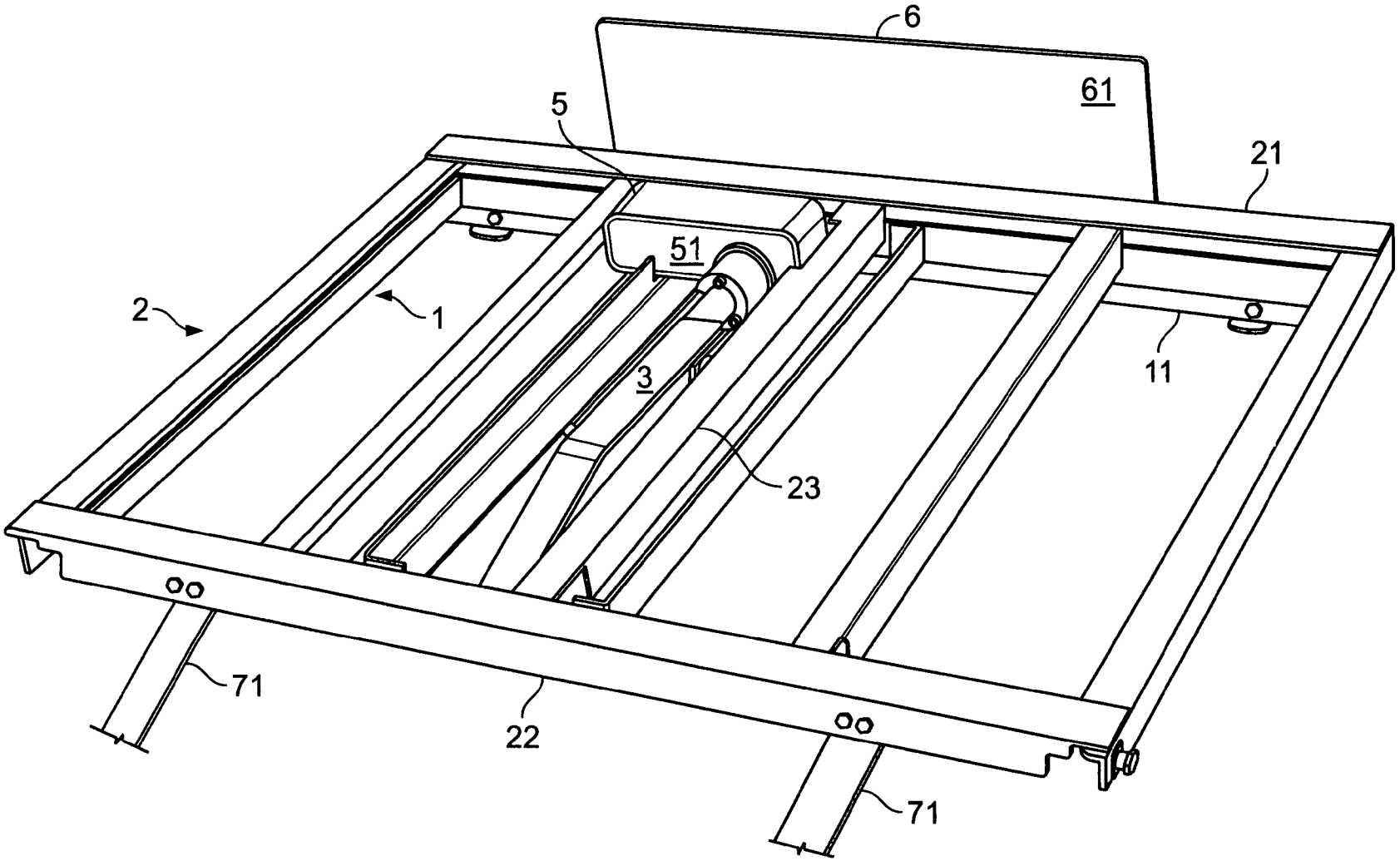
FIG. 2 shows a perspective view of a device according to an embodiment of the invention in a lowered position.

Mattress supporting frame 2 is adapted to nest over base frame 1 when the device is in a lowered position, as shown in FIG. 2, to minimize the vertical space required for the device. To achieve this nesting, a perimeter of mattress supporting frame 2 may be sufficiently wider and longer than a corresponding perimeter of base frame 1 to enable the nesting of driven upper or mattress supporting frame 2 over the lower, power driving base frame 1.

In this manner, the angle irons forming the side portions of base frame 1 are arranged with their horizontal legs extending outwardly and their vertical legs extending upwardly, as shown in FIG. 3. The angle irons forming the side portions of mattress supporting frame 2 are arranged with their horizontal legs extending inwardly and their vertical legs extending downwardly, as shown in FIG. 3. Likewise, any additional rails forming base frame 1 and mattress supporting frame 2 may be arranged and dimensioned so as to allow mattress supporting frame 2 to nest over base frame 1 when the device is in a lowered position.

The vertical legs of the angle irons forming the side portions of base frame 1 are further arranged to be spaced apart from the corresponding vertical legs of the angle irons forming mattress supporting frame 2. This arrangement provides a degree of safety and lessens the risk of accidents, such as having a hand or finger caught between the upper and lower frames or the grabbing of bedding materials between the frames. Appropriate notches or cutouts may be provided in the members of mattress supporting frame 2 to accommodate any components of the system used to drive mattress supporting frame 2 upward, such as linear actuator 5.

Two or more vertical end descent limiting stops may be provided at a first or free end 11 of base frame 1 for selectively limiting the downward descent of the mattress supporting frame 1. The stops may be repositioned vertically and may provide a relatively small incline, for example to be used as a substitute for a pillow.

As shown in FIG. 3, leveraging arm 3 is pivotally coupled to second side 12 of base frame 1. Leveraging arm 1 may have a hinge assembly at one end for providing the pivoting connection. As shown, the hinged portion of leveraging arm 3 may be secured to an inner side of the head rail forming the portion of the base frame distal the head of the mattress. For example, a hinged bracket may be secured to second side 12 base frame 1 with removable bolts. Preferably, levering arm 3 is coupled to base frame 1 at an approximately central portion with respect to the width of the mattress.

One or more roller bearings 4 are secured to leveraging arm 3. Roller bearing 4 is arranged on leveraging arm 3 to contact a portion of an underside of cross member 23 such that as leveraging arm 3 is raised and lowered by pivoting about its hinge, mattress supporting frame 2 is raised and lowered to a desired height.

A sound reducing or muting element 24 may be secured at a underside of cross member 23. Sound reducing element 24 may be positioned between cross member 23 and roller bearing 4 to reduce the sound produced as the device is raised or lowered. Preferably, sound reducing element 24 comprises a nylon block or other material suitable for muting or reducing the level of noise produced as roller bearing 4 contacts cross member 23.

A linear actuator 5 is disposed on base frame 1. Additional angle rails and/or brackets may be provided for mounting linear actuator 5, which may be removably mounted to base frame 1. Preferably, linear actuator 5 is pivotally mounted to a head rail at first side 11 of base frame 1, as shown for example in FIG. 3. The motor end of the linear actuator 5 may pivot from a bracket secured at the free end of the base frame 1.

Linear actuator 5 includes an electric motor 51 and a displaceable shaft or piston 52. Displaceable shaft 52 is pivotally coupled to leveraging arm 3. For example, shaft 52 may engage pivot holes provided in leveraging arm 3 with a removable bolt or clevis pin, a washer and a lock nut. Preferably, the shaft is coupled at a midpoint of the unified offset leveraging arm 3. Extension of shaft 52 pivots leveraging arm 3 upward, raising roller bearing 4 against cross member 23 and transferring the lifting force of linear actuator 5 to the underside of cross member 23 to lift mattress supporting frame 2.

A first mattress restraining or confining member 6 is disposed at first side 21 of mattress supporting frame 2 for preventing the mattress from shifting as the mattress is raised. During the tilting process, first mattress restraining member 6 prevents the mattress from sliding back past the upper end of the driven frame or mattress supporting frame 2.

First mattress restraining member 6 may comprise a substantially flat plate member 61 secured to first side 21 of mattress supporting frame 2 and extending substantially perpendicular to a plane of mattress supporting frame 2. Mattress restraining member 6 may be constructed from any suitable material, such as wood, plastic, metal or a composite material. As shown in FIG. 3, mattress restraining member 6 may be secured to a head rail of mattress supporting frame 2 with one or more brackets.

A second mattress restraining member 7 is disposed at a foot section of the mattress for preventing the mattress from shifting as the mattress is raised. Second mattress restraining member 7 may be in the form of a substantially flat plate positioned adjacent a foot portion of the mattress and extending substantially perpendicular to the plane of the mattress, similar to first mattress restraining member 6.

Figure 4:
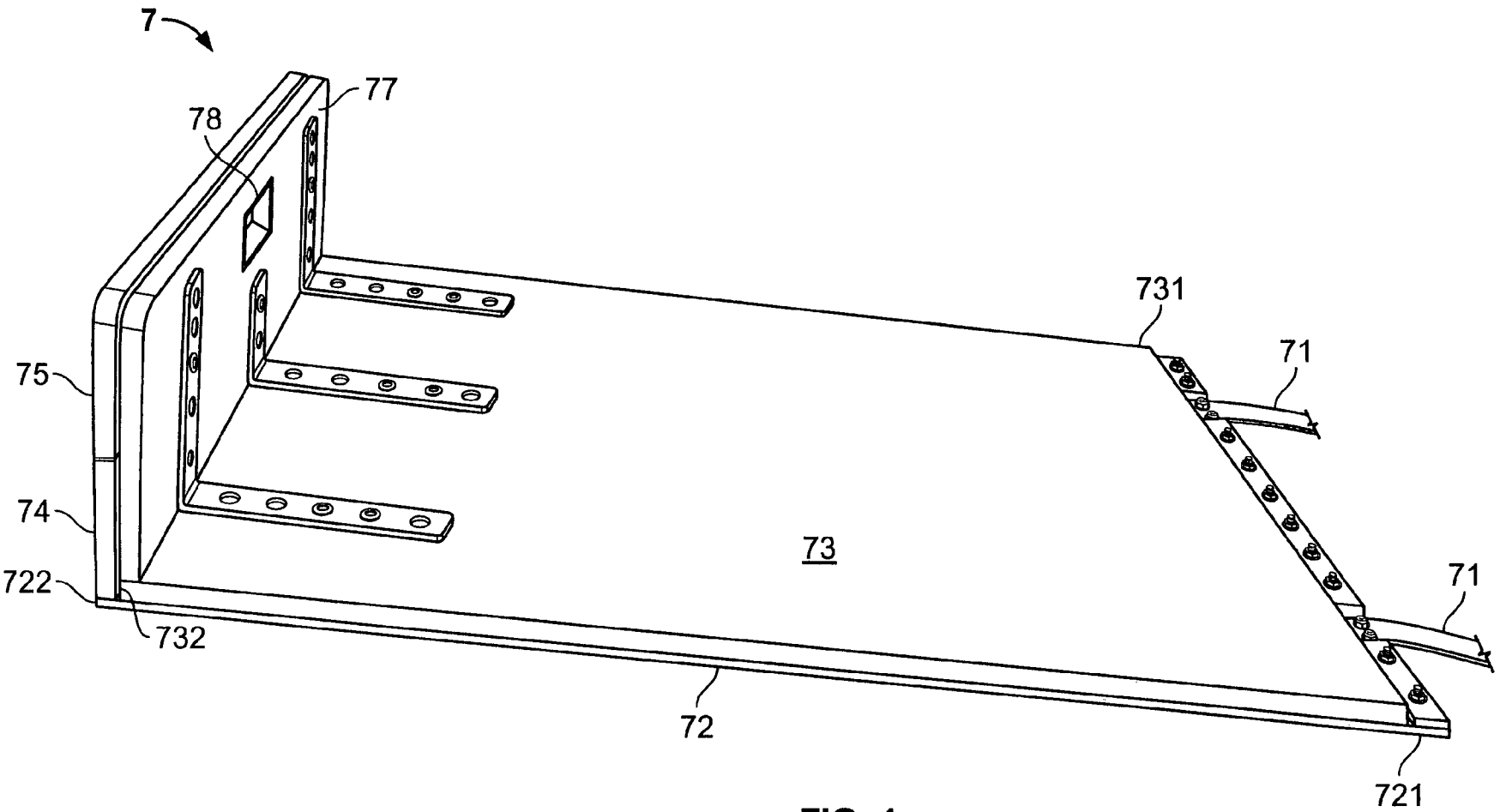
FIG. 4 shows a mattress restraining member according to an embodiment of the invention in a first position for maintaining a foot portion of the mattress in a substantially horizontal position.
Figure 5:
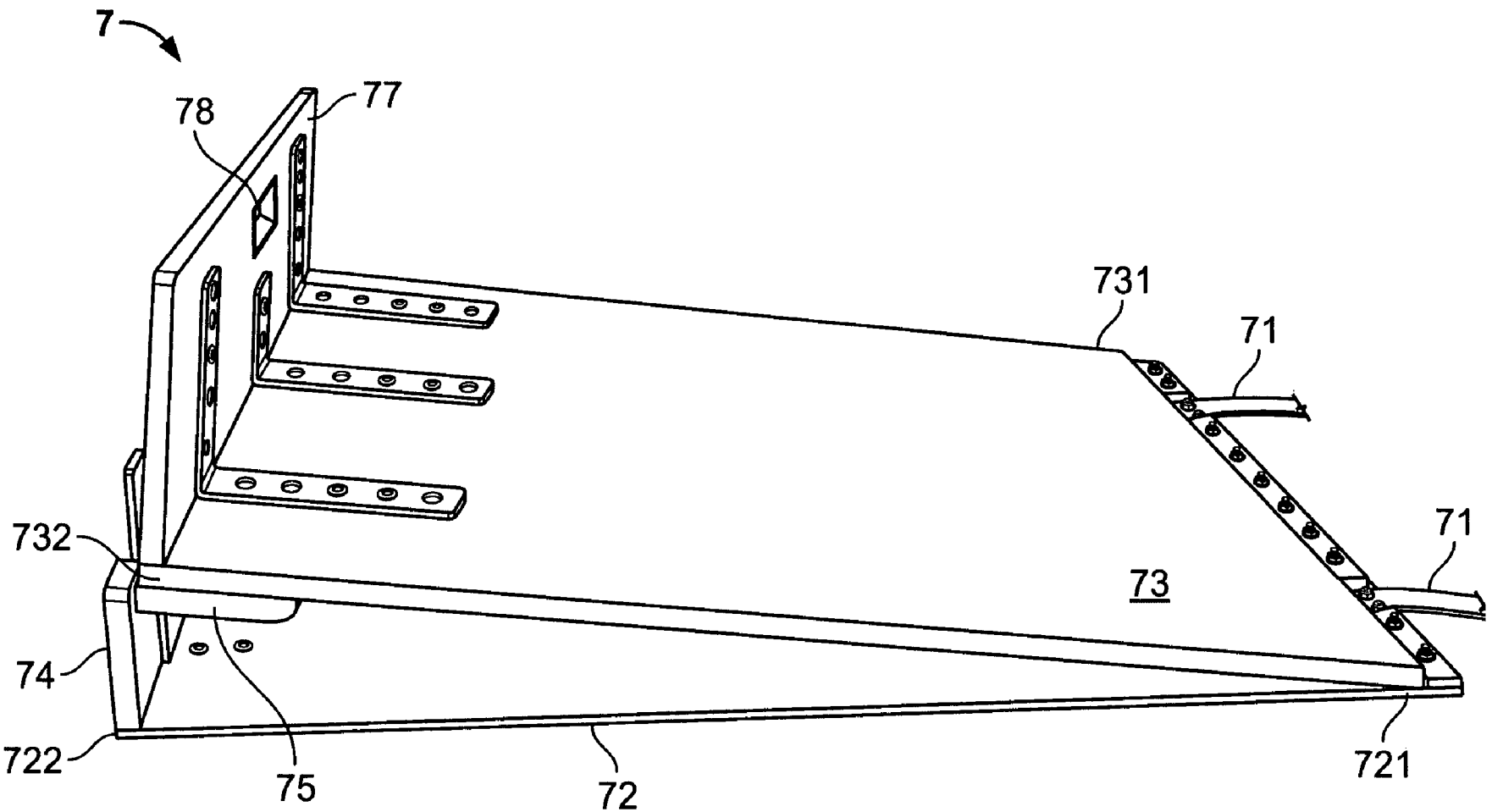
FIG. 5 shows the mattress restraining member shown in FIG. 4 in a second position for elevating a foot portion of the mattress.

As shown in FIGS. 1, 4 and 5, second mattress restraining member 7 may further comprise an assembly for providing a non-powered or manually-operated elevation feature for the foot portion of the mattress. As shown, second mattress restraining member 7 may have a base member or lower section 72 for resting on the box spring. Base member 72 has a first side 721 distal the foot end of the mattress and a second side 722 opposite first side 721 and proximate the foot end of the mattress.

A mattress supporting member or upper section 73 has a first side 731 pivotally coupled to first side 721 of base member 72 and a second side 732 opposite first side 721 of mattress supporting member 72. The pivotal connection between base member 72 and mattress supporting member 73 may provided using a hinge, for example a piano-type hinge or any other suitable means for allowing the two structures to pivot relative to one another.

A plate member 77 is disposed at second side 732 of mattress supporting member 73 for preventing the mattress from shifting as the mattress is raised. As shown in FIGS. 4 and 5, plate member 77 extends upwardly from and substantially perpendicular to mattress supporting member 73 and may be secured thereto with one or more L-shaped brackets.

An elevating member 74 is disposed at second side 722 of base member 72. The elevating member 74 extends upwardly from and substantially perpendicular to base member 72. A movable support 75 is pivotally coupled to an upper portion of elevating member 74. Movable support 75 is movable between a first position (shown in FIG. 4) substantially parallel to elevating member 74 for maintaining a foot portion of the mattress in a substantially horizontal position and a second position (shown in FIG. 5) substantially perpendicular to elevating member 74 for elevating the foot portion of the mattress. As shown, a recessed handle 78 may be provided in plate member 77 to assist in raising and lowering the assembly.

At least one bracket 76 may extend downwardly from elevating member 74 for limiting a movement of the second mattress retraining member 7 assembly as the mattress is raised. Brackets 76 serve to bring the second mattress restraining member assembly 7 into alignment with the foot end of the box spring 98.

The five rectangular plates which make up the second mattress restraining member 7 may be constructed from any suitable material, such as wood, plastic, metal or a composite material. The components may be joined together with suitable brackets and hinges. The dual position feature allows the mattress supporting member 73 to be left in a substantially horizontal position as shown in FIG. 4, or to be set to an incline, of for example, approximately six degrees, to accommodate patients whose legs are to be elevated.

One or more connecting straps 71 may be provided for securing second mattress restraining member 7 to mattress supporting frame 1. Connecting straps 71 may be adjustable in length to accommodate various mattress sizes. Connecting straps 71 may extend between a first end of mattress supporting member 73 or base member 72 and base frame 1. As mattress supporting frame 2 is lifted, connecting straps 71 are tightened. In particular, as the mattress is raised, connecting straps 71 initiate a pull on the second mattress restraining member assembly 7, thereby increasing pressure at both the head and foot ends of the mattress. Each tilting movement of the mattress supporting frame 2 tightens the connecting straps 71 in proportion to the degree of tilt, to increase pressure on each end of the mattress. This coordinated effort predictably shapes the mattress behavior and forces the mattress to bend closer to the pivoting end portion of the base frame 1 and mattress supporting frame 2

In this way a device according to an embodiment of the invention makes use of three restraining devices in order to limit the longitudinal movement of the mattress in either direction. The three restraining devices include first mattress restraining member 6 disposed at the head of the mattress, second mattress restraining member 7 disposed at the foot of the mattress and connecting straps 71 which connect the two assemblies. This arrangement performs multiple functions, including first forcing the mattress to bend sharply at the base of the incline and then preventing the mattress from oscillating up and down the upper, powered frame when the tilting is occurring. This coordinated effort properly shapes the mattress during the tilting process.

Accordingly, while a number of embodiments of the present invention have been shown and described, it is obvious that many changes and modifications may be made thereunto without departing from the spirit and scope of the invention.

What is claimed is:

1. A device for positioning between a box spring and a mattress for selectively raising at least a portion of the mattress, the device comprising:

a) a base frame secured to the box spring or to a frame supporting the box spring, said base frame comprising a first side disposed proximate a head section of the mattress and a second side disposed distal the head section;

b) a mattress supporting frame comprising a first side disposed proximate the head section of the mattress, a second side disposed distal the head section and a cross member extending therebetween, said second side of said mattress supporting frame being pivotally coupled to said second side of said base frame, wherein said base frame is adapted to nest within said mattress supporting frame when the device is in a lowered position to minimize the vertical space required for the device;

c) a leveraging arm pivotally coupled to said second side of said base frame;

d) a roller bearing secured to said leveraging arm;

e) a linear actuator disposed on said base frame, said linear actuator comprising an electric motor and a displaceable shaft pivotally coupled to said leveraging arm, wherein extension of said shaft pivots said leveraging arm upwardly, raising said roller bearing against said cross member to lift said mattress supporting frame;

f) a first mattress restraining member disposed at said first side of said mattress supporting frame for preventing the mattress from shifting as the mattress is raised; and g) a second mattress restraining member disposed at a foot section of the mattress for preventing the mattress from shifting as the mattress is raised; said second mattress restraining member comprising:

i) a base member for resting on the box spring, said base member having a first side and a second side opposite said first side;

ii) a mattress supporting member having a first side pivotally coupled to said first side of said base member and a second side opposite said first side of said mattress supporting member;

iii) a plate member disposed at said second side of said mattress supporting member for preventing the mattress from shifting as the mattress is raised;

iv) an elevating member disposed at said second side of said base member, said elevating member extending upwardly from and substantially perpendicular to said base member; and v) a movable support pivotally coupled to an upper portion of said elevating member;

wherein said movable support is movable between a first position substantially parallel to said elevating member for maintaining a foot portion of the mattress in a substantially horizontal position and a second position substantially perpendicular to said elevating member for elevating the foot portion of the mattress.

2. The device according to claim 1, wherein said base frame comprises a first substantially rectangular frame and said mattress supporting frame comprises a second substantially rectangular frame, wherein a perimeter of said first substantially rectangular frame and a perimeter of said second substantially rectangular frame are formed by a plurality of rigid members, each of said plurality of rigid members comprising a rail bent at a substantially right angle along a respective long direction.

3. The device according to claim 2, wherein said perimeter of said second substantially rectangular frame is larger than said perimeter of said first substantially rectangular frame.

4. The device according to claim 1, further comprising at least one anchoring strap secured to said base frame for securing said base frame to the box spring or to the frame supporting the box spring.

5. The device according to claim 1, wherein said first mattress restraining member comprises a substantially flat plate member secured to said first side of said mattress supporting frame.

6. The device according to claim 1, further comprising a sound reducing element disposed at a underside of said cross member for contacting said roller bearing and reducing a sound level produced as the device is raised or lowered.

7. The device according to claim 1, wherein said linear actuator is pivotally coupled to said first side of said base frame.

8. The device according to claim 1, further comprising at least one bracket extending downwardly from said first side of said base frame for limiting a movement of the device as the mattress is raised.

9. The device according to claim 1, further comprising at least one connecting strap for securing said second mattress restraining member to said mattress supporting frame, wherein said connecting strap is tightened as said mattress supporting frame is lifted.

10. The device according to claim 1, wherein said second mattress restraining member further comprises at least one bracket extending downwardly from said elevating member for limiting a movement of said second mattress retraining member as the mattress is raised.

* * * * *